US005675857A

United States Patent [19]

Hirse

[11] Patent Number: 5,675,857

[45] Date of Patent: Oct. 14, 1997

[54] MOP WITH A WATER-REMOVAL DEVICE

[76] Inventor: Gernot Hirse, Franz-Simon-Str. 29, D-65934 Frankfurt am Main, Germany

[21] Appl. No.: 675,928

[22] Filed: Jul. 5, 1996

[30] Foreign Application Priority Data

Jul. 5, 1995 [DE] Germany ..... 195 24 440.0

[51] Int. Cl.[6] ..... A47L 13/14; A47L 13/144

[52] U.S. Cl. ..... 15/119.1; 15/119.2; 15/260

[58] Field of Search ..... 15/116.1, 116.2, 15/119.1, 119.2, 120.1, 120.2, 260

[56] References Cited

U.S. PATENT DOCUMENTS 2,712,143 7/1955 Palma, Jr. et al. ..... 15/119.2
3,462,786 8/1969 Abbott .
4,164,800 8/1979 Strahs ..... 15/119.1
4,809,387 3/1989 Nakamura et al. .
5,172,446 12/1992 Schulein .

*Primary Examiner*—David Scherbel
*Assistant Examiner*—Terrence Till
*Attorney, Agent, or Firm*—Burns, Doane, Swecker & Mathis, L.L.P.

[57] ABSTRACT

A cleaning mop includes a hollow device handle carrying a mop head at its lower end. A cylindrical press sleeve is mounted on the outside of the device handle for longitudinal movement relative thereto. A press head stick is slidably mounted inside the device handle for longitudinal movement relative thereto. A press head is affixed to a lower end of the press head handle. The press head handle can be positioned such that the press head is spaced from a lower edge of the press sleeve to form a press gap therewith. By then raising the device handle, the mop can be pulled through the press gap to squeeze water therefrom.

13 Claims, 4 Drawing Sheets

MOP WITH A WATER-REMOVAL DEVICE

BACKGROUND OF THE INVENTION

The subject of the invention is a cleaning device having a handle which is attached to a mop head that carries absorbent material. The device has a press sleeve which can be moved along the handle and is open at its lower end for expressing water from the absorbent material.

Those cleaning devices, referred to generally as mops, are used to mop floors and other areas which need to be cleaned with water. There already are numerous cleaning devices which have a press device for expressing water from the cleaning rag or mop attached to the handle. They have in common that the press device can be moved along the handle to eliminate the need for manual squeezing or wringing out the water. In these customary devices the press-rollers of the press device must be guided towards the mop in order to carry out a squeezing process. After the process is completed they must be guided back laterally so that they do not prevent the mop from unfolding. This system requires a corresponding mechanical device such as a lever, special guides, press-rollers which move in a slanting direction and are self-clamping etc.

One of the known problems with the customary cleaning devices is that the mop which usually is comprised of a closed bunch of cleaning strips or cleaning fibers must have a certain minimum thickness when it has a round or square base so that it can absorb a sufficient amount of water and can clean adequately. A mop which has this minimum thickness which ranges from 7 to 10 cm, for example, can only be squeezed out with an unreasonable amount of pressure whereby the outer areas of the press gap of the mop cannot receive an adequate amount of pressing power. If a sufficient amount of cleaning head material is used then the manual pressing power on the soft cleaning head material which contains water and dirt, is too weak to provide sufficient pressing power on the inside area of the mop.

This is also the problem with a customary cleaning device (Nakamura et al. U.S. Pat. No. 4,809,387). In that case, the mop which is attached to the mop head is pulled through two opposing press-rollers when a press sleeve, to which these press-rollers are attached in a mobile manner in slanted slots, are moved along the mop. This device has a relatively complicated structure. Since the squeezing action depends on the movement of the press-rollers, the squeezing effect is not always ensured if the press-rollers do not move along their guide slots in the desired manner. In addition there is the chance that the press-rollers may jam in their guide slots unless narrow dimensional tolerances are used which ensure an exact guide path. Since the two press-rollers only act from opposing sides, there is an uneven squeeze effect on the mop whereby the edge of the mop are not squeezed out sufficiently. In yet another cleaning device (European Document 0 457 943) the wiper head is only squeezed out from two opposite sides as well. In this case the wiper-head is comprised of a cleaning rag which therefore has a relatively small amount of material and whose cleaning effect, as a consequence, is lower.

In a customary cleaning device as described in the introduction (Abbott U.S. Pat. No. 3,462,788) the cylinder-shaped press sleeve has openings in its lower area. The mop is squeezed out by placing the lower, open end of the press sleeve on a surface and by subsequently compressing the mop on the inside of the press sleeve while the water exits from the openings in the press sleeve. Such a squeezing process requires a considerable amount of force but the effect is nonetheless insufficient.

The object of the invention therefore is to provide a cleaning device as described in the introduction which makes it possible to carry out an effective squeezing process on the entire mop in a simple manner while the construction is simple and the force required is minimal.

SUMMARY OF THE INVENTION

The object of the invention is attained in that an axially moveable press head is located inside the mop which can be held in an axial position relative to the press sleeve, in which there is an annular press gap formed between the circumference of the press head and the press sleeve. The annular mop can then be pulled through the annular press gap for squeezing-out water.

The use of an outer press sleeve and an internal press head results in the formation of an almost annular press gap through which the mop which forms an annular curtain, can be pulled. All areas of the mop are squeezed out evenly since the thickness of this annular curtain is relatively small. The annular shape also ensures that there are no open edge areas in which there is no sufficient pressing power. The mop material is distributed equally and is exposed to an even, high pressing power in the press gap. The emerging water is pushed downward on the inside as well as on the outside of the annular mop, i.e. towards the free ends of the cleaning strips. This results in an effective squeezing out of the mop with little force.

Because the press sleeve and the press head move independently of each other and relative to the mop head, a simple, relative movement of these parts can result in a press gap which is sufficiently narrow for the squeezing process with the press gap opening completely after the completion of the squeezing process simply by lowering the mop head to make the press head free for lowering or by moving the press sleeve and the press head relative to each other in order to release the mop.

The cleaning device can even be used under restricted spatial conditions since the outside diameter of the cleaning device which is determined by the press sleeve is only a little larger than that of the mop head and since the outside diameter of the press head is smaller than that of the mop head. Especially the use in an extreme slanted position is still possible.

Usually such a mop is made of absorbent, freely hanging cleaning strips or cleaning fibers. For reasons of simplicity the term "cleaning strips" is used in the following paragraphs. This is not to exclude, however, the mop being comprised of an annular curtain of a single or multi-part cleaning rag.

In accordance with a preferred embodiment of the invention the press sleeve has a circumferential press lip along its open end. This increases the squeezing effect and protects the mop against damage.

The press head preferably is connected to a press head stick which is movable along the device handle.

It is practical to be able to fix the press sleeve axially in a position on the press head stick with the press lip and the press head being on approximately the same axial height in this position, or the press head may be positioned a bit lower than the press lip. This means that these two parts can be fixed with regard to each other in a relative position in which they form the press gap through which the mop then is pulled when the mop head is moved relative to the press gap.

An especially advantageous embodiment proved to be one in which the press sleeve and the press head stick can be connected by means of a catch coupling so that these two parts can lock into place in the relative axial position to each other which is desirable for the squeezing process.

BRIEF DESCRIPTION OF THE INVENTION

The objects and advantages of the invention will become apparent from the following detailed description of a preferred embodiment thereof in connection with the accompanying drawing in which like numerals designate like elements, and in which.

Figure 2:
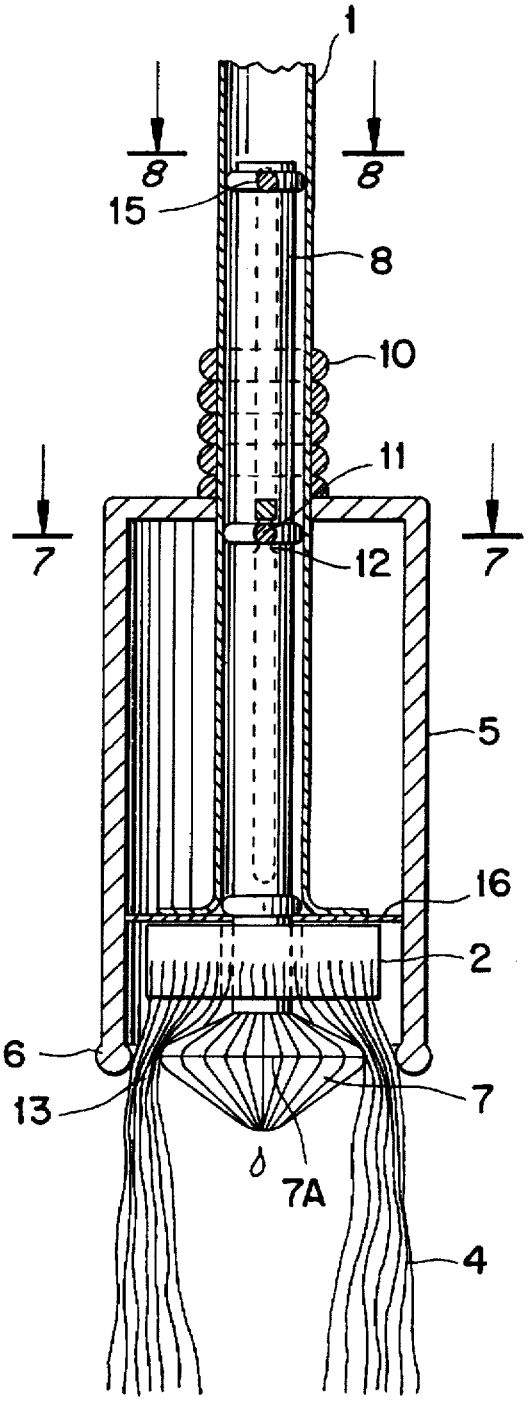
FIG. 2 is a view similar to FIG. 1 after a press head has been connected to a press sleeve to form therebetween a press gap.
Figure 5:
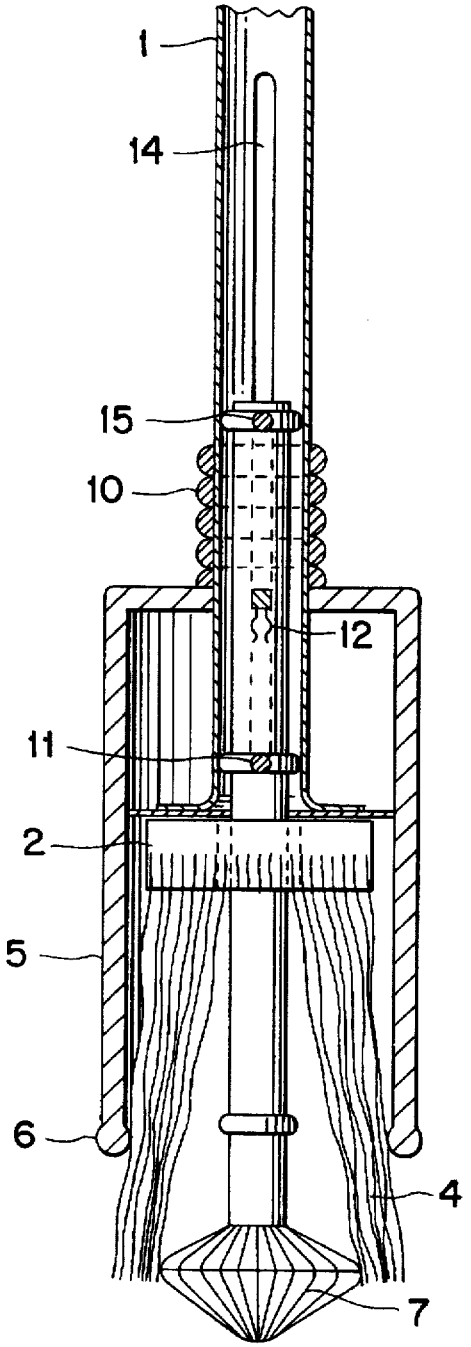
FIG. 5 is a view similar to FIG. 4 once the press head has been released from the press sleeve to enable the squeezed mop to be moved downwardly.
Figure 6:
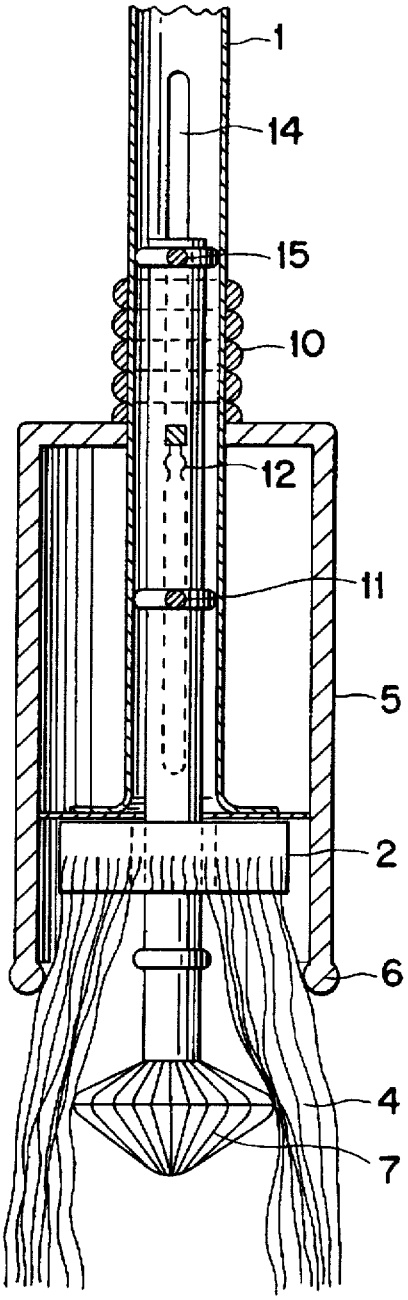
Figure 7:
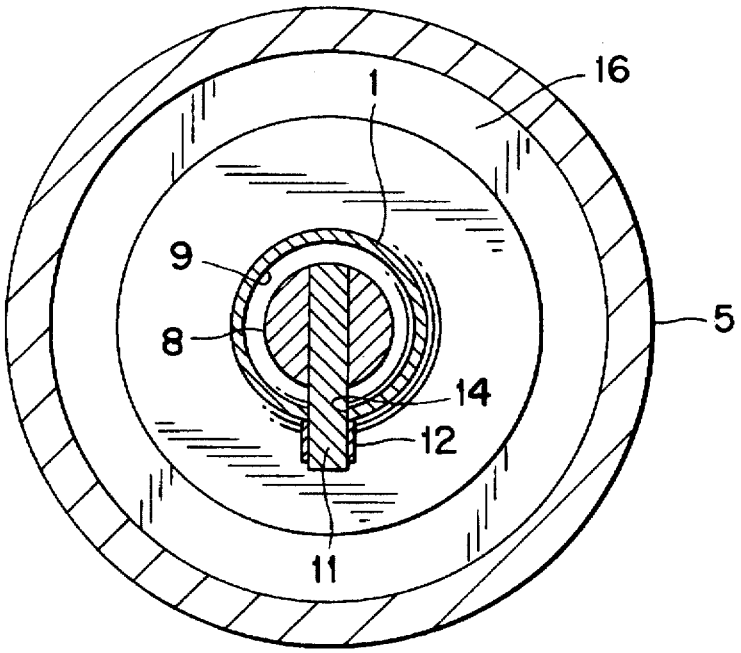
Figure 8:
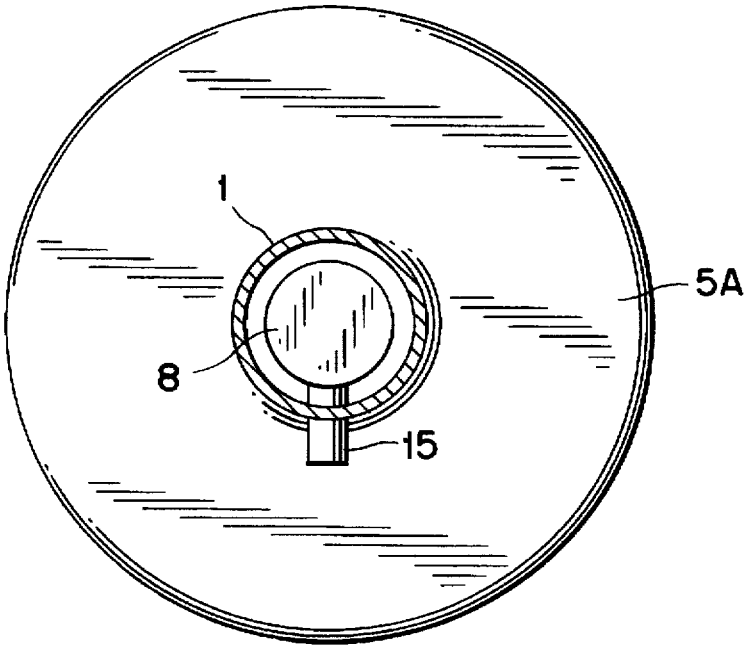

FIG. 6 is a view similar to FIG. 5 once the mop has moved down almost completely out of the press sleeve; and FIGS. 7 and 8 are cross sectional views taken along lines 7—7 and 8—8, respectively, in FIG. 2.

DETAILED DESCRIPTION OF A PREFERRED EMBODIMENT OF THE INVENTION

Figure 1:
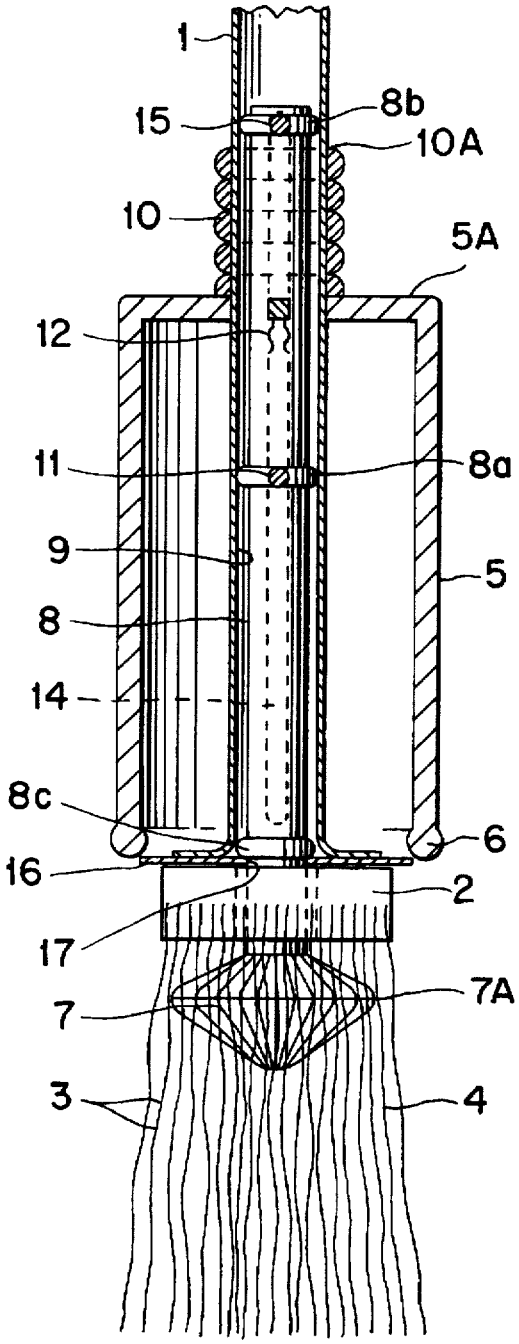
FIG. 1 is a longitudinal sectional view of a cleaning device according to the invention, with its parts in the cleaning position.

The cleaning device which is shown in FIG. 1 in its basic position, parts of it in a sectional view, has a hollow device handle 1 whose lower part is connected to an annular mop head 2. The mop head 2 has a mop 4 comprised of absorbent cleaning strips 3 with the mop forming an annular curtain comprised of the cleaning strips 3 due to the annular shape of the mop head 2 in the position shown in FIG. 1. In this context the cleaning strips could also comprise cleaning fibers. Deviating from this described exemplary embodiment it is also possible to use a single or multi-part cleaning rag which makes up the annular curtain.

A cylindrical press sleeve 5 which includes a closed upper end can be moved axially along the handle. The press sleeve is open at its lower end which faces the mop 4. There is a circumferential press lip 6 along the lower edge of the press sleeve 5. A press head 7 located centrally inside the mop 4 preferably is symmetrical about the handle axis and displays the basic shape of two composed, flat truncated cones meeting at a rounded circumferential edge 7A. In the exemplary embodiment shown there are water drips which can run in the direction of the surface lines on the outside surface of the press head 7.

The press head 7 is connected to a press head stick 8 which is guided coaxially and telescopingly in a longitudinal bore 9 of the device handle 1 via two circumferential projections 8*a* and 8*b* which act as two guide bodies disposed at an axial distance from each other.

Figure 3:
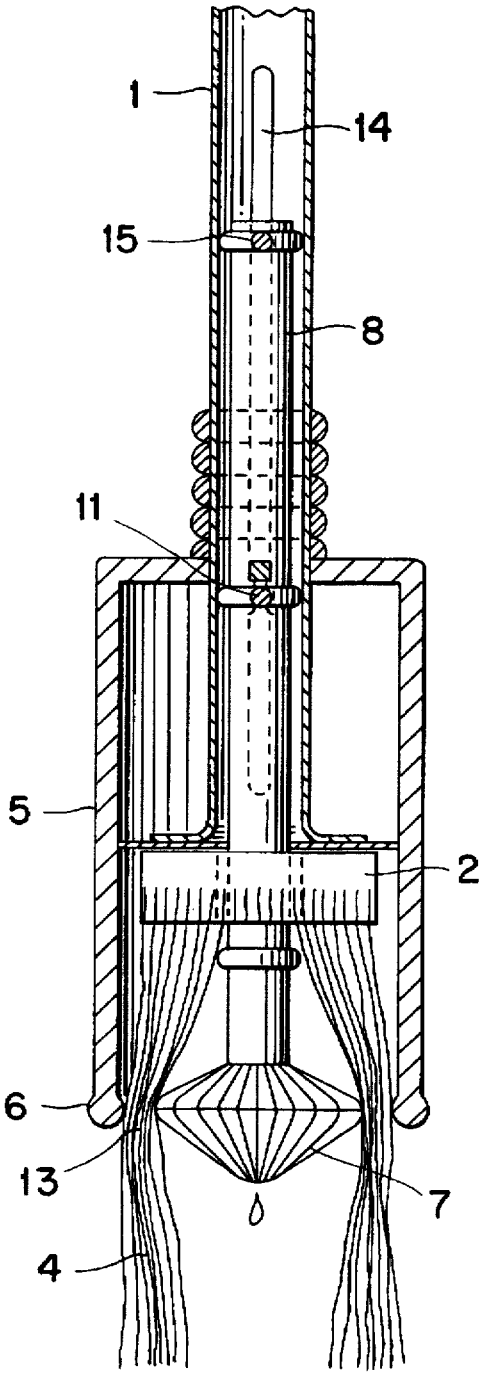
FIG. 3 is a view similar to FIG. 2 after the mop has been partially pulled through the press gap.

The press sleeve 5 (which has a handle 10 at its upper end), the device handle 1 (which carries the mop head 2) and the press head stick 8 (connected to the press head 7), can all move axially with regard to each other. The press sleeve 5 and the press head stick 8 can (but need not) be connected by means of a coupling which, in the exemplary embodiment, includes a lateral bolt 11 connected to the press head stick 8, and spring catch clamps 12 mounted at the upper end of the press sleeve 5. The bolt 11 passes through longitudinal slots 14 formed in the device handle 1. In response to upward movement of the press head stick 8 relative to the press sleeve 5, the bolt 11 can become releasably captured by the spring catches 12. Thus, the press sleeve 5 can be fixed axially on the press head stick 8 in a position in which the press lip 6 and the edge 7A of the press head 7 are at approximately the same vertical level, as is shown in FIG. 2. In this position an annular press gap 13 is formed between the press lip 6 and the outside circumference of the press head 7 through which the mop 4 is pulled when (starting from the position in accordance with FIG. 2) the device handle 1 is pulled up relative to the press sleeve 5 or when the press sleeve 5 is pushed downward relative to the device handle 1 (FIG. 3). At the end of this relative movement (shown in FIG. 4) the mop strips 3 will have passed through the press gap 13 and will have been squeezed out in this manner. The spring catch clamps 12 could be omitted, whereby the press head 8 could be held in its squeezing position according to FIG. 2 solely by friction forces caused by mop 4 when being pulled upward relative to the press lip 6.

The press head stick 8 may have a lateral projecting pin 15 at its upper end which extends through the slot 14 and overlies a top wall 10A of the press sleeve handle 10. The pin 15 serves to limit the axial movement of the press sleeve 5 relative to the press head 7. It also may be used to release the press sleeve 5 from its latched connection with the press head stick 8 in the end position of the squeezing process shown in FIG. 4 (in case the clamps 12 are provided) so that the press sleeve 5 can be pulled up along the device handle 1 (as is shown in FIG. 5) without moving the press head 7 upward simultaneously. This releases the mop 4 and allows the cleaning strips 3 to unfold in an unimpaired manner and without jamming. As is shown in FIG. 6 the press head 7 is lifted subsequently until all other parts are back into their starting position in accordance with FIG. 1.

The mop head 2 carries a rubber disk 16 at its top face, the outer circumference of the disk positioned beneath the press lip 6 during use of the mop, so that the press sleeve 5 is locked in its retracted (upward) position (FIG. 1). This prevents the press sleeve 5 from slipping downward during the cleaning process.

In addition, the disk 16 has an inside circumference 17 above which a circumferential projection 8*c* of the press head stick 8 locks into place in its retracted (upward) position (FIGS. 1 and 2). Alternatively, those outside and inside circumferences could be defined by separate disks.

The operation of the mop will now be explained.

FIG. 1 depicts the mop in a working position for cleaning a floor. When the mop is ready to have the water squeezed therefrom, a user applies a downward force to the press sleeve 5, with one hand, while pulling up on the device handle 1 with the other hand. That causes the device handle 1 to rise relative to the press sleeve 5, taking along with it the press head stick 8, since the protrusion 8*c* is locked above the rubber disk. Eventually, the lateral bolt 11 becomes captured by the spring catches 12, as shown in FIG. 2, but this is not necessary. In that position, the edge 7A of the press head 8 is aligned with the bead 6 of the sleeve to define the press gap 13. Then, a squeezing of the cleaning strips 3 begins.

Figure 4:
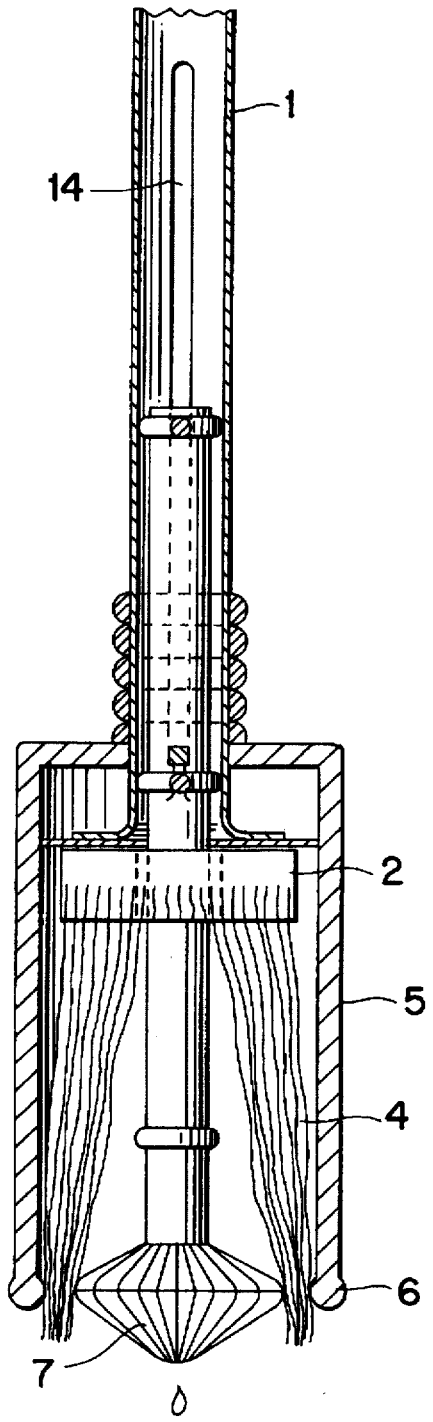
FIG. 4 is a view similar to FIG. 3 once the mop has been fully pulled through the press gap.

While continuing to pull up on the device handle 1 and press down on the sleeve 5, the device handle 1 and mop head 2 move upwardly relative to the press sleeve 5 and the press head 7, whereupon the cleaning strips 3 are pulled through the press gap 13 formed between the press head 7 and the press sleeve 5, to squeeze out water, as shown in FIGS. 3 and 4.

After the bottom of the slot 14 abuts against the lateral bolt 11, no further upward travel of the mop head 2 relative to the press sleeve 5 can occur. Then, if necessary, the operator may push down on the pin 15 while holding the handle 10 of the press sleeve 5 to cause the lateral bolt 11 to become disengaged from the spring catches 12. The device handle 1 and the press head stick 8 move downwardly together relative to the press sleeve 5, as shown in FIG. 5. It will be appreciated that the downward movement of the press head 7 creates sufficient space between the press head 7 and the press sleeve 5 to enable the cleaning strips 3 to move downwardly from the press sleeve as shown in FIG. 6. Hence, the mop head 2 is returned to the working position of FIG. 2. Then, by lowering the entire device, the press head 7 will bear against the floor and be pushed back up to the FIG. 1 position, whereupon the mopping operation can be recommenced.

Although the present invention has been described in connection with a preferred embodiment thereof, it will be appreciated by those skilled in the art that additions, deletions, modifications, and substitutions not specifically described may be made without departing from the spirit and scope of the invention as defined in the appended claims.

What is claimed is:

1. A cleaning device comprising:

a device handle having a longitudinal axis and a mop of absorbent material disposed on a lower end therof;

a press sleeve mounted on the device handle for longitudinal movement relative thereto, the press sleeve including a downwardly open end and an inside wall spaced laterally outwardly from the device handle;

a press head mounted for longitudinal movement relative to both the device handle and the press sleeve, whereby the press head is locatable in a squeezing position wherein said press head forms a press gap with a portion of the press sleeve;

the device handle being movable upwardly relative to the press sleeve and press head to pull the absorbent material through the press gap for squeezing water therefrom.

2. The cleaning device according to claim 1, further including a connector for releasably locking the press head to the press sleeve to prevent longitudinal movement therebetween.

3. The cleaning device according to claim 2, further including a press head stick fixed to the press head and mounted to the device handle in telescoping relationship.

4. The cleaning device according to claim 3, wherein the coupler comprises a spring catch mounted on the press sleeve, and a lateral bolt mounted on the press head stick and arranged to be captured in the spring catch in response to upward movement of the press head stick relative to the press sleeve.

5. The cleaning device according to claim 4, wherein the device handle is hollow, and the press head stick is mounted inside of the device handle, a herein a common longitudinal axis of the device handle and the press head stick coinciding with a center axis of the press sleeve.

6. The cleaning device according to claim 4, wherein the lateral bolt passes through a longitudinal slot formed in the device handle.

7. The cleaning device according to claim 4 further including a lateral projecting pin fixed to the press head stick and overlying a top surface of the press sleeve.

8. The cleaning device according to claim 3, wherein the press head stick includes a radially outward projection; and further including an elastic disk affixed to the device handle for longitudinal movement therewith; the elastic disk arranged to be engaged by the projection to yieldably resist downward movement of the press head handle relative to the device handle.

9. The cleaning device according to claim 1, wherein the press gap is of annular configuration.

10. The cleaning device according to claim 1, wherein the press sleeve includes an enlarged press lip at a lower end, the press lip forming the press gap, together with the press head.

11. The cleaning device according to claim 1, further including an elastic disk affixed for longitudinal movement with the device handle; the elastic disk arranged to be engaged by the press sleeve to yieldably resist downward movement of the press sleeve relative to the device handle as a mopping operation is being carried out.

12. The cleaning device according to claim 1, wherein the press head includes generally conical portions extending upwardly and downwardly respectively, from a vertical center of the press head.

13. The cleaning device according to claim 1, wherein the press sleeve comprises a cylindrical wall and a top wall closing an upper end of the cylindrical wall, the device handle passing through the top wall along a central axis of the cylindrical wall.

* * * * *